US005292208A

United States Patent [19]

Berger

[11] Patent Number: 5,292,208

[45] Date of Patent: Mar. 8, 1994

[54] CORNER ADAPTER FOR CORRUGATED BARRIERS

[75] Inventor: Lawrence E. Berger, Sterling Heights, Mich.

[73] Assignee: C-Loc Retention Systems, Inc., Utica, Mich.

[21] Appl. No.: 960,980

[22] Filed: Oct. 14, 1992

[51] Int. Cl.[5] ..... E02D 29/02; E02D 5/00

[52] U.S. Cl. ..... 405/281; 405/278; 405/274

[58] Field of Search ..... 405/281, 278, 262, 280, 405/279, 274, 272

[56] References Cited

U.S. PATENT DOCUMENTS

| | | | |
|---|---|---|---|
| 1,171,281 | 2/1916 | VandeVort | 405/281 |
| 2,001,473 | 5/1935 | Smith | 405/278 |
| 2,050,934 | 8/1936 | Ditchburn | 405/281 |
| 2,642,018 | 6/1953 | Weeber | 405/278 X |
| 4,674,921 | 6/1987 | Berger | 405/281 X |
| 4,917,543 | 4/1990 | Cole et al. | 405/281 X |

FOREIGN PATENT DOCUMENTS

| | | | |
|---|---|---|---|
| 437932 | 11/1935 | United Kingdom | 405/281 |

*Primary Examiner*—Dennis L. Taylor
*Attorney, Agent, or Firm*—Dykema Gossett

[57] ABSTRACT

A corner adapter for use with corrugated barrier sections is disclosed. The corner adapter provides great freedom of movement in the relative angles between adjacent barrier sections. Further, an inventive cross-section for the corrugated section provides a high strength barrier.

10 Claims, 3 Drawing Sheets

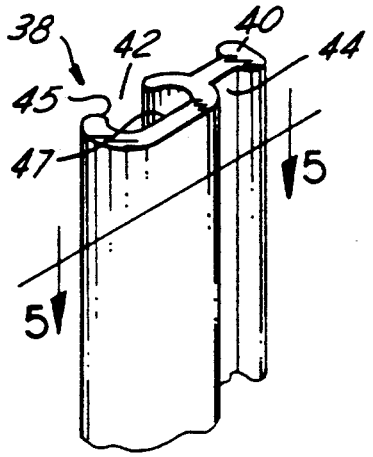
FIG.4
FIG.5
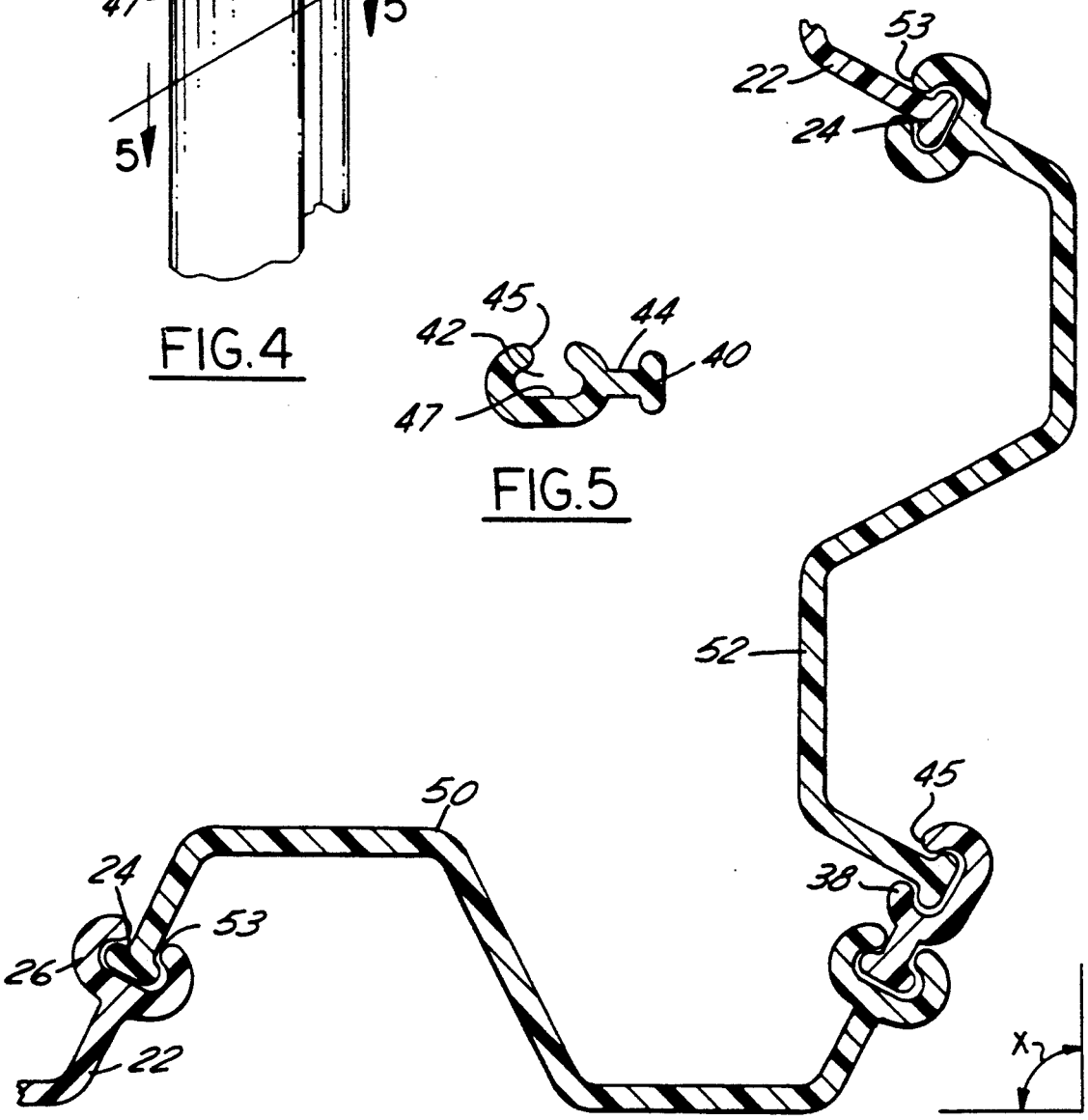
FIG.6

CORNER ADAPTER FOR CORRUGATED BARRIERS

BACKGROUND OF THE INVENTION

This invention relates to a corner adapter for use with corrugated sectional barriers.

In the prior art, plastic corrugated sections which are connected together with tongue and groove connections to form barriers, such as a seawall, have become increasingly popular. Examples of such plastic sectional seawalls are shown in U.S. Pat. Nos. 4,674,921 and 4,690,588, invented by the inventor of the present invention.

With such constructions, a plurality of corrugated barrier sections are connected adjacent to one another by interconnecting tongue and groove connections. The sections prove surprisingly strong, and provide an adequate seawall barrier.

It would be desirable, however, to provide such a seawall wherein adjacent corrugated barrier sections may be turned relative to each other. Further, it would be desirable to provide a very high strength section. The present invention is directed to providing such features.

SUMMARY OF THE INVENTION

In a disclosed embodiment of the present invention, adjacent corrugated barrier sections are interconnected by tongue and groove connections. A corner adapter has a tongue section and a groove section. The corner adapter tongue is inserted into a groove oil a first barrier section, and a mating tongue section from an adjacent barrier section is received in the corner adapter groove. An entrance to the corner adapter groove extends along a direction which is non-parallel to the corner adapter tongue. The tongue and grooves on the barrier sections typically extend along parallel directions. By utilizing the corner adapter, one can achieve a barrier wherein adjacent sections turn relative to each other.

In further features of the present invention the corner adapter may be reversed to provide more freedom of turning with regard to adjacent barrier sections. Additionally, the sections themselves may be reversed to provide even additional freedom in the number of angles which can be provided between adjacent sections. In a further feature of the present invention, an extension section is formed between the groove and the tongue on the corner adapter. This provides additional distance between the groove on one seawall or barrier section, and the tongue on the adjacent seawall or barrier section.

In a preferred embodiment of the present invention the corrugated barrier sections are formed of planar portions. The disclosed planar sections form a relatively high strength barrier.

It should be understood that other corrugated cross sections can be utilized. As an alternative example, the above-referenced United States Patents disclose curved corrugated sections. Further, although the disclosed barrier sections have particular advantages when used as a seawall, they also have benefits in other types of barriers.

These and other features of the present invention can be best understood from the following specification and drawings, of which the following is a brief description.

BRIEF DESCRIPTION OF THE DRAWINGS

FIG. 4 is a perspective view of a corner adapter according to the present invention.

FIG. 5 is a cross-sectional view along line 5—5 of FIG. 4.

FIG. 6 is a cross-sectional view showing a first configuration of a barrier incorporating the corner adapter.

DETAILED DESCRIPTION OF A PREFERRED EMBODIMENT

Figure 1:
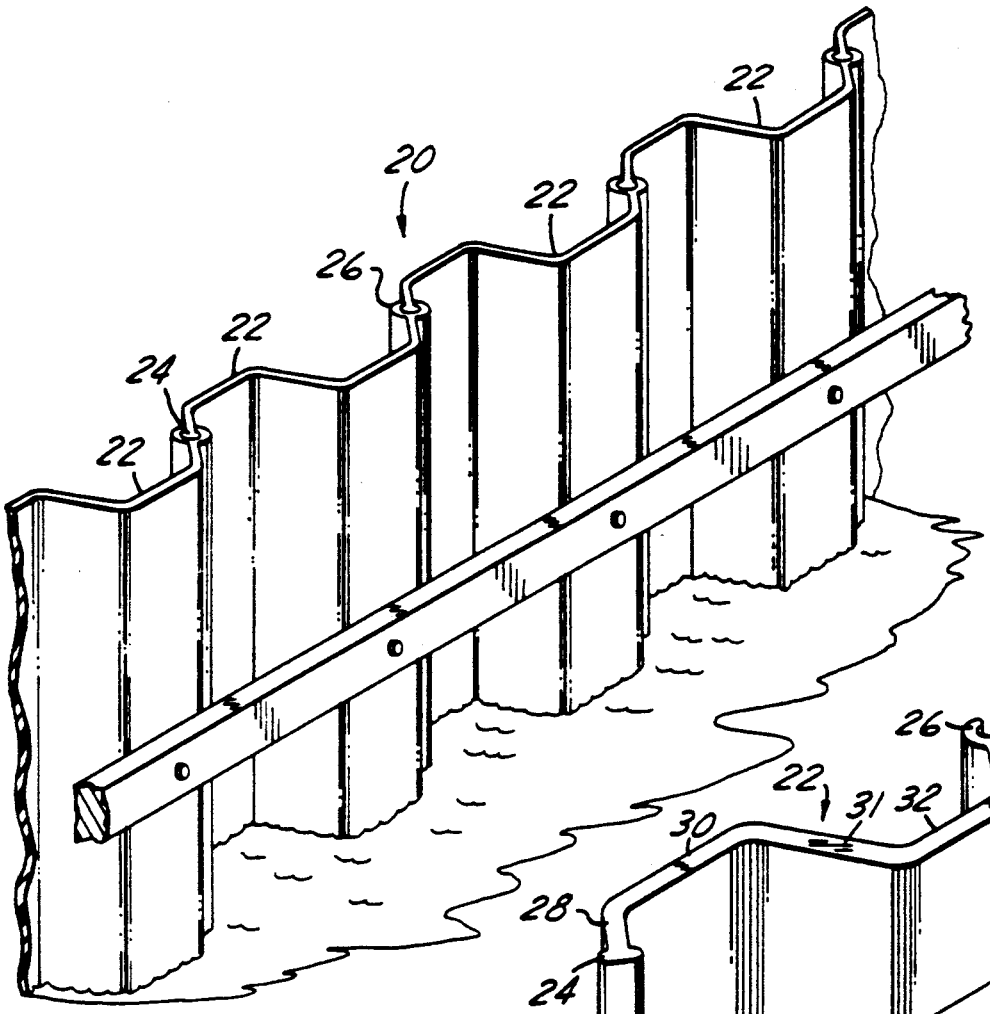
FIG. 1 is a perspective view of a barrier section.

A seawall 20 incorporates a plurality of adjacent corrugated sections 22. Each section is preferably formed of plastic, and includes tongue 24 at one end and C-shaped groove 26 at the other end. The tongues 24 are received in grooves 26 from an adjacent section to provide the seawall. Although seawalls are disclosed, the features of this invention may extend to other types of barriers.

Figure 2:
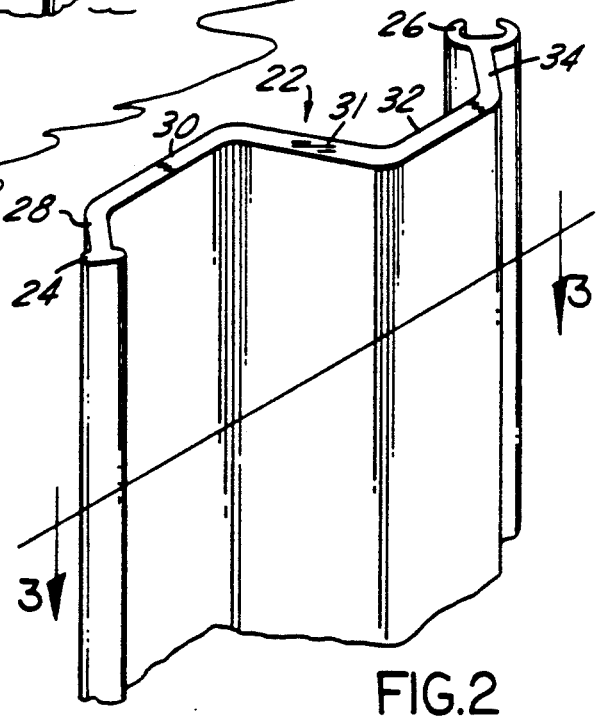
FIG. 2 is a perspective view of one corrugated section utilized to form a barrier.
Figure 3:
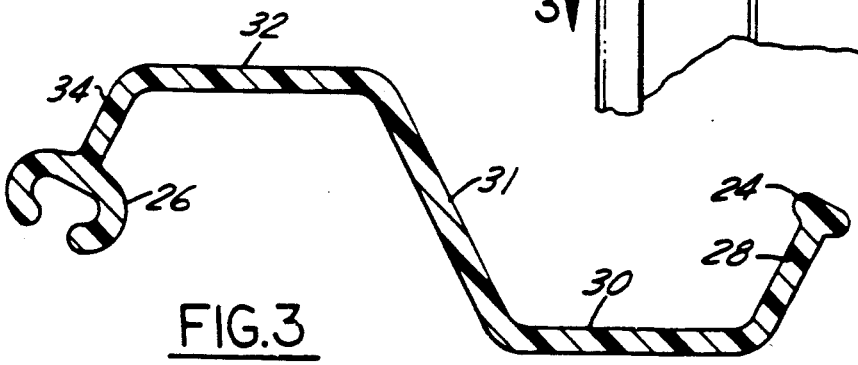
FIG. 3 is a cross-sectional view along line 3—3 of FIG. 2.

As shown in FIG. 2, each section 22 consists of a first planar section 28 leading at an angle from tongue 24 to a second planar section 30. Planar section 30 leads to an angled third section 31 which leads to a fourth planar section 32. Planar section 32 is connected to an angled fifth planar section 34 which leads to groove 26. This is also shown in the cross-sectional view in FIG. 3. Sections 30 and 32 are parallel, and sections 28 and 34 are parallel. This cross-section provides increased strength in some barrier applications.

A corner adapter 38 is shown in FIG. 4. Corner adapter 38 includes a tongue 40 and a groove 42 connected to tongue 40 by an extension 44. An entrance 45 to groove 40 extends to a groove base 47 in a direction which is non-parallel to the direction of extension 44. In the preferred embodiment, extension 44 extends along an plane which is perpendicular to an plane extending through entrance 45 and towards base 47. That is, entrance 45 defines a plane across its front. An plane which extends perpendicular to that plane and towards base 47 would be generally perpendicular to the direction of extension 44. This is also shown in the cross-sectional view illustrated in FIG. 5. The plane of the extension also passes between a plane of entrance 45 and a plane of groove base 47.

As shown in FIG. 6, when a first seawall section 50 is connected to an adjacent seawall section 52 with corner adapter 38 intermediate the two, an angle X may be defined between adjacent sections 50 and 52. As shown, angle X is approximately 90° with this configuration. This is true since the entrance 45 is at a non-parallel angle relative to extension 44. As shown, the corresponding entrance 53 to the grooves 26 on the sections is generally parallel to the direction of the tongues 24 that they received.

Figure 7:
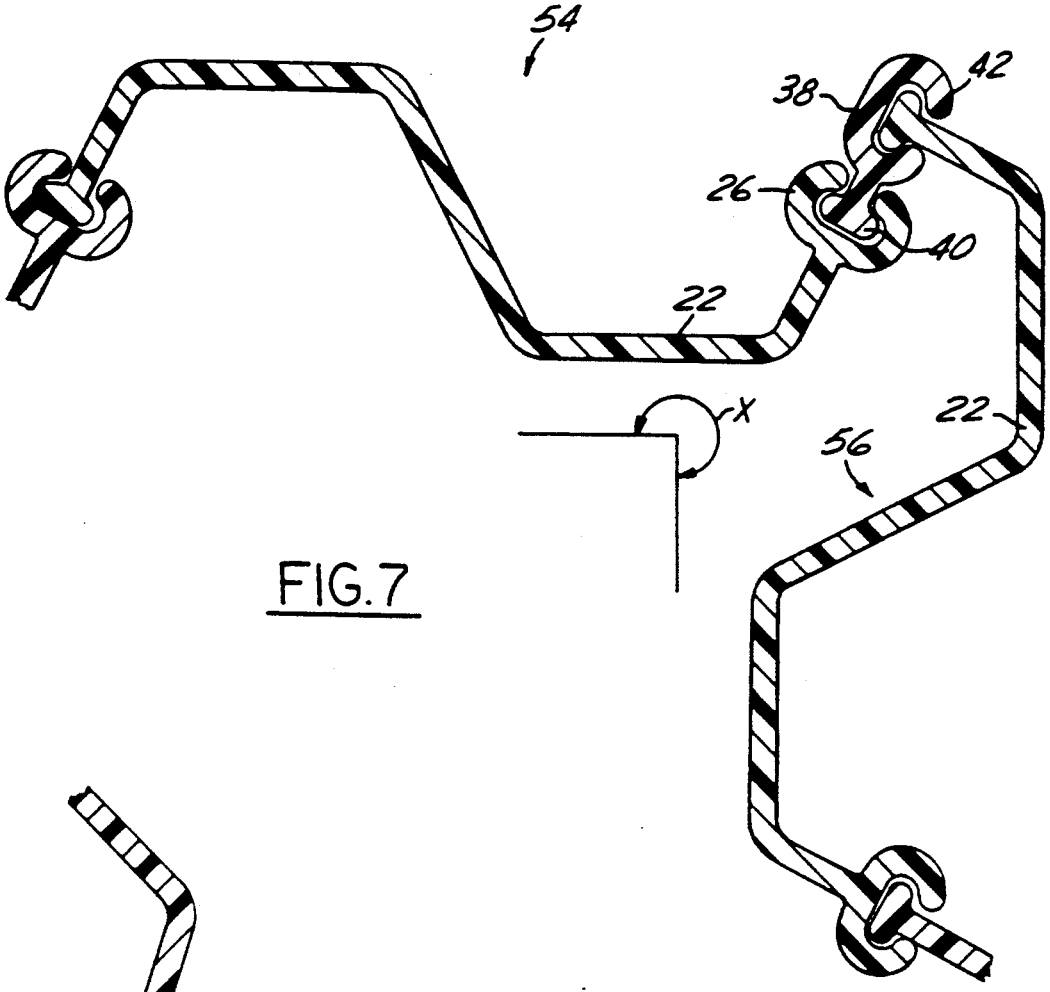
FIG. 7 is a cross-sectional view showing a second configuration of a barrier.

As shown in FIG. 7, the corner adapter 38 may be reversed from the position shown in FIG. 6. In this way, an angle X of approximately 270° may be achieved between adjacent sections 54 and 56.

Figure 8:
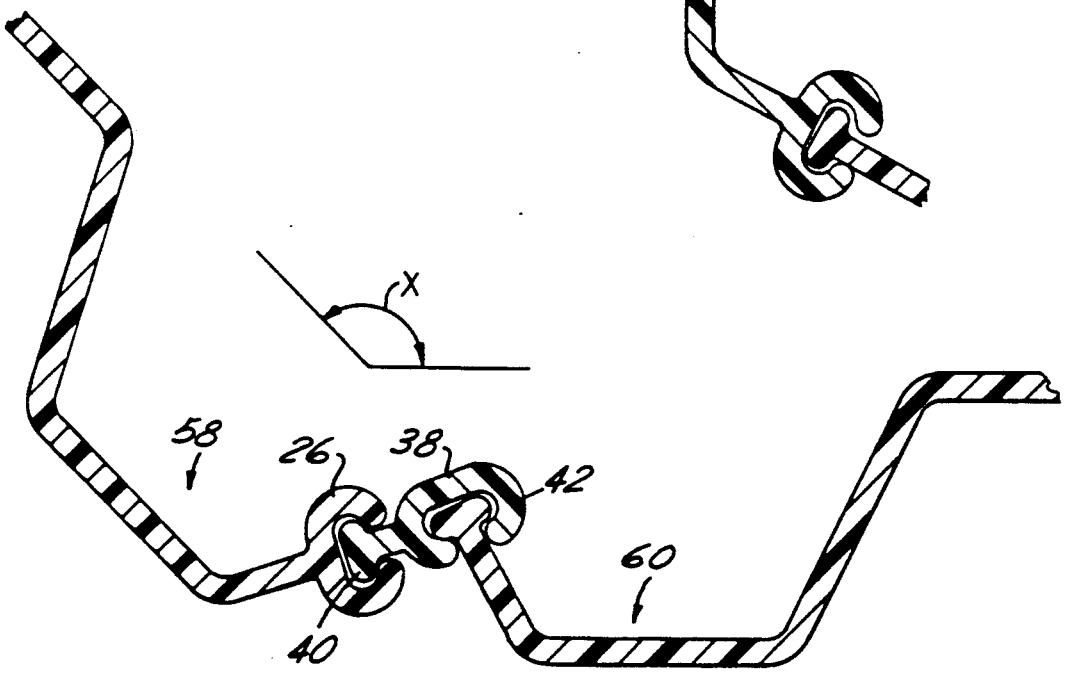
FIG. 8 is a cross-sectional view showing a third configuration of a barrier.

As shown in FIG. 8, adjacent sections 58 and 60 may be separated by an angle X of approximately 120°. To this end, the section 60 would be reversed from the position shown in FIG. 7.

Preferably, the sections are all molded from plastic. They may have a toughened outer coating. Although planar corrugations are illustrated, it should be understood that the inventive corner adapter could also be utilized with curved corrugations.

Although a preferred embodiment of the present invention has been disclosed, a worker of ordinary skill in the art would recognize that certain modifications would come within the scope of this invention. For that reason the following claims should be studied in order to determine the true scope and content of this invention.

I claim:

1. A barrier comprising:

a first corrugated section having a tongue at one lateral end and a groove at an opposed lateral end;

a second corrugated section having a tongue at one lateral end positioned adjacent said groove on said first corrugated section, and a groove at an opposed lateral end; and a corner adapter having an adapter groove receiving said tongue of said second corrugated section and having a tongue received in said groove of said first corrugated section, said corner adapter resulting in a barrier wherein said first and second corrugated sections extend at an angle relative to each other, said adapter groove having an entrance and a groove base, said adapter groove including a first plane extending from the center of said entrance towards the center of said groove base, said tongue including a second plane, said tongue extending from said groove along said second plane, said first and second planes being substantially non-parallel, said second plane passing into said adapter groove intermediate said groove base and said entrance.

2. A barrier as recited in claim 1, wherein said corner adapter may be reversed to change said angle.

3. A barrier as recited in claim 1, wherein said planes are perpendicular.

4. A barrier as recited in claim 1, wherein said corrugations are formed of planar sections.

5. A barrier as recited in claim 1, wherein said first and second corrugated sections are molded of plastic.

6. A barrier as recited in claim 1, wherein said tongue on said corner adapter is connected to said groove on said corner adapter by an extension section.

7. A corner adapter for use with corrugated barrier sections comprising:

a generally C-shaped groove, and a tongue spaced from said groove, said groove having an entrance and a base spaced from said entrance, said groove including a first plane being defined as extending through the enter of said entrance and towards the center of said base, said first plane bisecting said groove, said tongue including a second plane being defined as extending along said tongue and bisecting said tongue, said first and second planes being substantially non-parallel, said second plane passing into said groove intermediate said groove base and said entrance.

8. A corner adapter as recited in claim 7, wherein said corner adapter is molded of plastic.

9. A corner adapter as recited in claim 7, wherein an extension connects said tongue to said groove.

10. A corner adapter as recited in claim 7, wherein said first and second planes are perpendicular.

* * * * *